US011228842B2

(12) United States Patent
Xiao

(10) Patent No.: US 11,228,842 B2
(45) Date of Patent: Jan. 18, 2022

(54) ELECTRONIC DEVICE AND CONTROL METHOD THEREOF

(71) Applicant: Lenovo (Beijing) Co., Ltd., Beijing (CN)

(72) Inventor: Rongbin Xiao, Beijing (CN)

(73) Assignee: LENOVO (BEIJING) CO., LTD., Beijing (CN)

( * ) Notice: Subject to any disclaimer, the term of this patent is extended or adjusted under 35 U.S.C. 154(b) by 5 days.

(21) Appl. No.: 16/833,296

(22) Filed: Mar. 27, 2020

(65) Prior Publication Data

US 2020/0314554 A1 Oct. 1, 2020

(30) Foreign Application Priority Data

Mar. 28, 2019 (CN) ..... 201910245112.6

(51) Int. Cl.

| | |
|---|---|
| ***H04R 17/00*** | (2006.01) |
| ***H04R 3/04*** | (2006.01) |
| ***H04R 1/24*** | (2006.01) |
| ***H04R 1/28*** | (2006.01) |

(52) U.S. Cl.

CPC ..... *H04R 17/00* (2013.01); *H04R 1/24* (2013.01); *H04R 1/2803* (2013.01); *H04R 3/04* (2013.01)

(58) Field of Classification Search

CPC . H04R 1/028; H04R 1/20; H04R 1/24; H04R 1/26; H04R 1/2803; H04R 3/00; H04R 3/04; H04R 3/06; H04R 3/14; H04R 7/045; H04R 9/06; H04R 9/066; H04R 11/02; H04R 17/00; H04R 17/10; H04R 2400/03; H04R 2400/07; H04R 2499/11; H04R 2499/15

See application file for complete search history.

(56) References Cited

U.S. PATENT DOCUMENTS

| | | | | |
|---|---|---|---|---|
| 2009/0103767 | A1* | 4/2009 | Kuroda | H04R 1/02 381/388 |
| 2014/0301596 | A1 | 10/2014 | Wang et al. | |
| 2015/0010173 | A1* | 1/2015 | Bernal Castillo | H04R 1/24 381/162 |
| 2015/0323996 | A1* | 11/2015 | Obana | A63F 13/2145 345/177 |
| 2016/0366260 | A1* | 12/2016 | Wang | H04M 1/6041 |
| 2019/0149908 | A1* | 5/2019 | Kim | H04R 1/2826 381/388 |
| 2019/0191240 | A1* | 6/2019 | Ham | H04R 1/2834 |
| 2019/0208300 | A1* | 7/2019 | Lee | H04R 9/025 |
| 2020/0059713 | A1* | 2/2020 | Noh | H04R 1/028 |
| 2020/0228898 | A1* | 7/2020 | Starnes | H04R 9/063 |

FOREIGN PATENT DOCUMENTS

| | | |
|---|---|---|
| CN | 103839525 A | 6/2014 |
| CN | 106937206 A | 7/2017 |
| CN | 109408023 A | 3/2019 |

* cited by examiner

*Primary Examiner* — Thang V Tran

(74) *Attorney, Agent, or Firm* — Anova Law Group, PLLC

(57) ABSTRACT

An electronic device is provided, including a display screen; actuators configured to drive the display screen to vibrate; and a controller configured to control at least one of the actuators to operate and drive the display screen to produce a sound through vibration.

14 Claims, 5 Drawing Sheets

ELECTRONIC DEVICE AND CONTROL METHOD THEREOF

CROSS-REFERENCE TO RELATED APPLICATION

This application claims priority to Chinese Patent Application No. 201910245112.6, entitled "Electronic Device and Control Method Thereof," filed on Mar. 28, 2019, the entire content of which is incorporated herein by reference.

FIELD OF TECHNOLOGY

The present disclosure relates to the field of information processing technology and, more specifically, to an electronic device and a control method thereof.

BACKGROUND

Different from the way a speaker outputs audio data, in screen sound technology, an actuator in an electronic device vibrates at an operating frequency that is consistent with an original input audio data, the vibration of the actuator drives a display screen of the electronic device to generate different degrees of vibration, and the vibration of the display screen generates sound waves that can be transmitted to the user's ear, thereby forming the output audio of the electronic device. Limited by the size of the actuator itself, the operating frequency of the actuator is generally limited. As such, the frequency range of the output audio obtained based on the screen sound technology only corresponds to a part of the audio in the original audio data. The partial frequency range of the output audio makes the sound perceived by the user relatively monotone. For example, only the low-frequency part of the original audio data can be restored and output by the screen, and the listening experience is poor. A method of realizing screen sound in multiple frequency bands (such as at least one of high, low, and intermediate frequency bands) such that the audio received by the user is no longer monotone is needed to improve the user experience.

BRIEF SUMMARY OF THE DISCLOSURE

One aspect of the present disclosure provides an electronic device. The device includes a display screen; actuators configured to drive the display screen to vibrate; and a controller configured to control at least one of the actuators to operate and drive the display screen to produce a sound through vibration. The display screen is driven to produce sounds in different frequency ranges when different numbers of the actuators are operating.

Another aspect of the present disclosure provides a control method, applied to an electronic device including a display screen and actuators. The method includes: controlling at least one of the actuators to operate and drive the display screen to produce a sound through vibration. The display screen is driven to produce sounds in different frequency ranges when different numbers of the actuators are operating.

BRIEF DESCRIPTION OF THE DRAWINGS

In order to illustrate the technical solutions in accordance with the embodiments of the present disclosure more clearly, the accompanying drawings to be used for describing the embodiments are introduced briefly in the following. It is apparent that the accompanying drawings in the following description are only some embodiments of the present disclosure. Persons of ordinary skill in the art can obtain other accompanying drawings in accordance with the accompanying drawings without any creative efforts.

DETAILED DESCRIPTION

In order to make the objectives, technical solutions, and advantages of the present disclosure clearer, the technical solutions in the embodiments of the present disclosure will be described below with reference to the drawings. It will be appreciated that the described embodiments are some rather than all of the embodiments of the present disclosure. Other embodiments conceived by those having ordinary skills in the art on the basis of the described embodiments without inventive efforts should fall within the scope of the present disclosure. In the situation where the technical solutions described in the embodiments are not conflicting, they can be combined. In addition, the steps shown in the flowchart of the accompany figures may be executed in the computer system for a set up computer executable instructions; and although the logic sequence is shown in the flowchart, the shown or described steps may be implemented in an order different from that of this situation in some case.

It can be understood that the electronic devices provided in the embodiments of the present disclosure may refer to any terminals capable of having a screen sound function, such as mobile phones, various types of computers such as tablet computers, industrial control computers, personal computers, integrated computers, notebook computers, e-readers, etc. Further, the terminals may also be wearable devices such as smart glasses, smart watches, and smart shoes. The electronic device described in the embodiments of the present disclosure is a mobile phone.

In order to facilitate the understanding of the embodiments of the present disclosure, the principle of using a single actuator to implement screen sound will be described first.

Figure 5A:
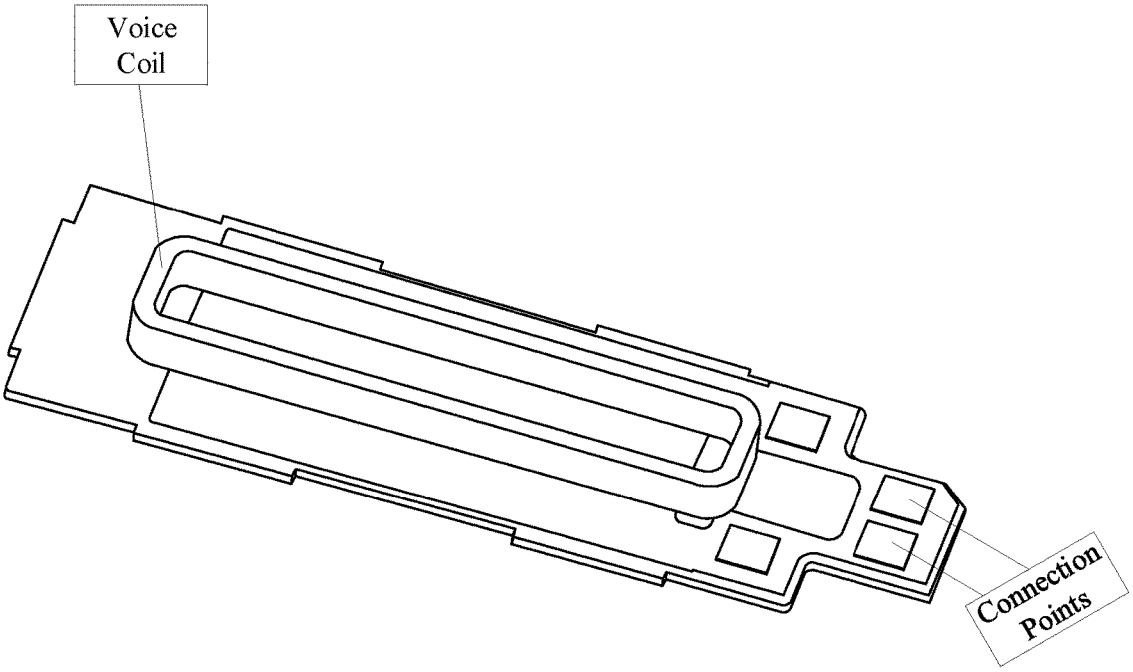
FIGS. 5A and B are diagrams of the working principle of a single actuator according to an embodiment of the present disclosure.
Figure 5B:
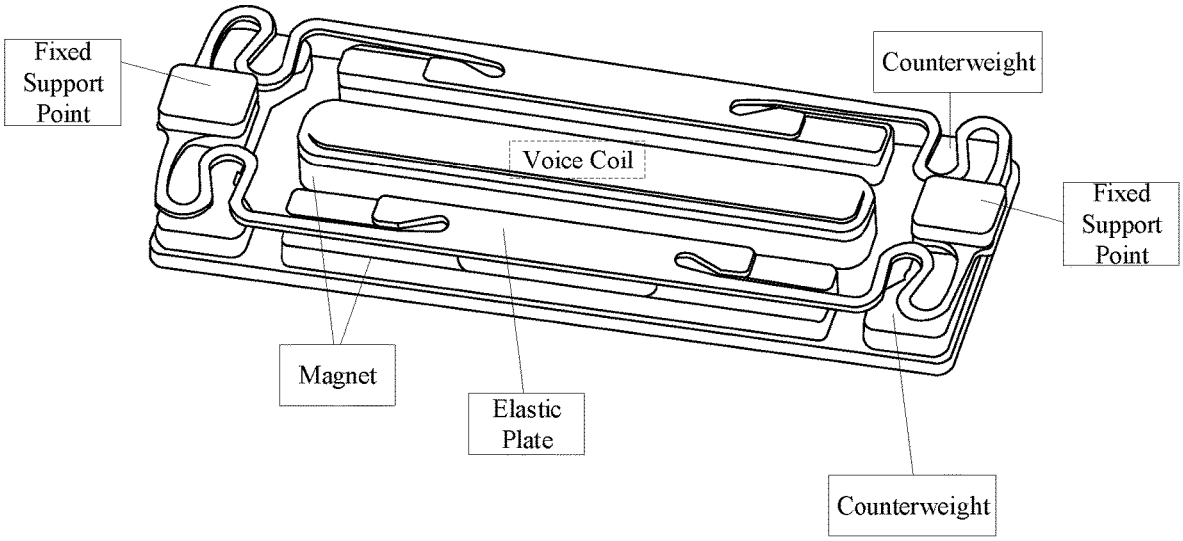
Figure 6:
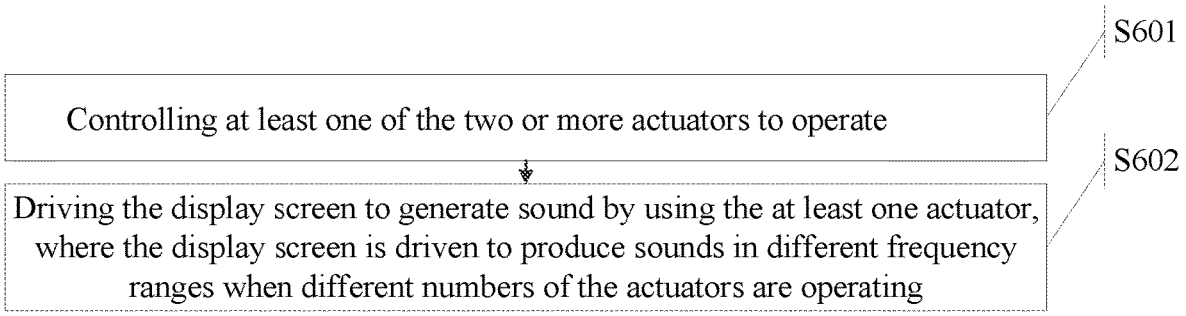
FIG. 6 is a flowchart of a control method according to an embodiment of the present disclosure.

As shown in FIG. 5A, which is a diagram of an actuator, the actuator includes at least a coil (voice coil) and is disposed on a substrate of an electronic device. An electrical signal, e.g., an audio source signal, can be provided to the voice coil through a plurality of connection points. The electrical signal input to the voice coil is generally an alternating signal, which can be negative or positive at different times. When an alternating signal is input, the voice coil is equivalent to a current-carrying conductor. The current-carrying conductor may generate a force under the influence of a magnetic field formed by a magnet (e.g., the voice coil shown in FIG. 5A is wedged between a magnet and an elastic plate shown in FIG. 5B such that the voice coil is disposed within the magnetic field formed by the magnet). The generated force may be referred as Lorentz force. Driven by the force described above, the voice coil may move, hence producing the vibration of the actuator. The motion generated by the actuator (e.g., the voice coil included in the actuator) can drive the elastic plate to produce motion (in some embodiments, the elastic plate may be a spring, and the material may be relatively soft). Since the voice coil may be fixed by a plurality of fixed support points, a reaction force may be generated corresponding to the force described above (e.g., Lorentz force). The reaction force can drive a magnetic circuit system composed of the magnet and a counterweight to generate an alternating motion. The alternating motion is transmitted to the display screen, which drives the display screen to vibrate. The combined vibrations of the voice coil and the display screen can generate a sound wave at certain frequency in the air and the sound wave is thereby listened to by the user. For example, for a voice coil with an operating frequency of 100 Hz under the action of an alternating signal, the voice coil may generate 100 vibrations per second. The vibration of the frequency may generate a vibration force, which can drive the display screen to vibrate. The vibration generated by the display screen can push the air on the surface of the display screen to generate motion, thereby generating sound waves. Due to the large area of the display screen relative to a single actuator, the vibration force generated by 100 vibrations per second of the voice coil may cause the display screen to generate different amplitudes of motion that can push the surface air, thereby generating sound waves of different wavelengths. Sound waves of different wavelengths may correspond to different frequencies of audio (not just the audio source of 100 Hz) from an audio perspective. Therefore, a single actuator can restore the audio source based on the operating frequency of the actuator. The above is a description of the screen sound technology.

Based on the foregoing description, with the screen sound technology using a single actuator, the operating frequency of the single actuator is relatively limited, which may further limit the bandwidth of the restored signal. In order to meet the increasing demand for bandwidth, two or more actuators are provided in the technical solutions of the present disclosure. Each actuator may work at its own operating frequency to generate vibration. The display screen may generate more sound waves with different wavelengths based on the combined vibration of each actuator to push air on the surface of the display screen, thereby obtaining more frequency signals and wider audio signals. The technical solutions of the present disclosure will be described below.

Figure 1:
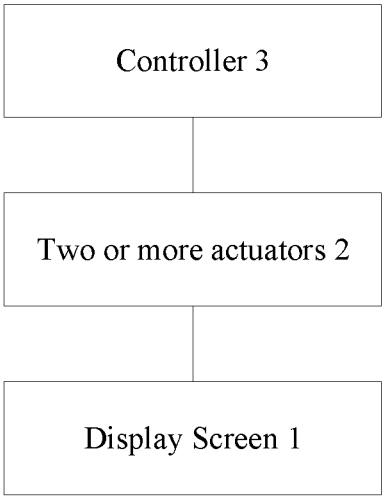
FIG. 1 is a structural diagram of an electronic device according to an embodiment of the present disclosure.

According to an embodiment of the present disclosure, as shown in FIG. 1, the electronic device includes a display screen 1, two or more actuators 2, and a controller 3. The controller 3 may be configured to control at least one of the two or more actuators 2 to be in an operating state to drive the display screen 1 to emit sound. In other words, the controller 3 may be configured to control at least one of the two or more actuators 2 to operate and drive the display screen to produce a sound through vibration.

In some embodiments, the numbers of the two or more actuators 2 in different operating state may be different, and the frequency bands of the sound emitted by the display screen may be different. That is, when different numbers of the two or more actuators are operating, the display screen is driven to produce sounds of different frequency ranges. Frequency band, as used herein, may also be referred as frequency range.

In the embodiment described above, by providing two or more actuators and controlling one or more of the two or more actuators to work, the display screen may emit sound in different frequency bands. Since the numbers of actuators in the operating state may be different, the frequency band of the display screen may be different, therefore, audio signals in different frequency bands may be obtained by controlling the numbers of actuators in the operating state. As such, users may listen to richer audio data, and the user experience may be improved.

In some embodiments, the operating frequencies of the two or more actuators 2 may be different or partially the same, or the operating frequencies of the two or more actuators 2 may be the same. Operating frequency of an actuator, as used herein, may refer to operating frequency range of the actuator. The operating frequency range may be an attribute of the actuator. Actuators having partially same operating frequencies may refer to actuators with overlapping frequency range and their own non-overlapping range. In addition to providing two or more actuators in the embodiments of the present disclosure, the two or more actuators may be designed to have different operating frequencies or the same frequency, or there may be two or more actuators 2 among all of the actuators 2 that are designed to have the same operating frequency, which will not be described in detail. In the embodiments of the present disclosure, to realize the sound of the display screen 1 of various frequency bands of high, intermediate, and low frequencies, and to restore the original (input) audio source as much as possible, the operating frequency of each actuator 2 may be different. It can be understood that the operating frequency of each actuator 2 can be a specific value or a range of values. In some embodiments, a range of values may be used, for example, the operating frequency of the actuator may be from 20 Hz to 20 kHz. For example, the audio source may include signals of different frequencies at different timestamps, the controller may adjust the frequency of the AC signal based on the audio source and current timestamp, thereby driving an actuator to produce sound of a corresponding frequency within its operating frequency range.

In the two or more actuators 2 provided in the embodiments of the present disclosure, each actuator 2 can be attached to different positions on the display screen, such that the vibration generated by the actuator 2 can produce the sound of the display screen 1. In practical applications, on one hand, since the space of the electronic device is relatively limited, generally, one or more actuators 2 may be disposed near the edge of the display screen 1, and one or more actuators 2 may be disposed near the center position of the display screen 1. In some cases, the edge of the display screen 1 may need to be adhered to the housing of the electronic device, and there may be no adhesion of the housing to the display screen 1 at the center position. The vibration of the actuators 2 may be affected by the adhesion at the edge of the display screen 1. As such, the display screen may not be able to produce a desired sound. Further, in generally, the operating frequency of the actuator located near the center of the display screen is the frequency of the audio signal most desired to be restored in the audio source. In order to ensure the priority restoration of the frequency, the controller 3 may need to control at least the actuator near the center of the display screen to be in the operating state.

In addition, considering that a user commonly hears signals of 20 Hz to 20 kHz, if the frequency band of the original audio source includes this frequency band and other frequency bands higher than this frequency band, the operating frequency of the actuator(s) 2 that are relatively near the center position of the display screen 1 is set to be lower than the operating frequency of the actuator(s) 2 that are relatively far from the center position of the display screen 1, such as the actuators 2 provided near the edge of the display screen 1. It can be understood that that the actuators 2 should be disposed inside the electronic device, and the installation position of the actuators 2 should be located at a position where the inside of the electronic device and the back of the display screen 1 can fit.

In the two or more actuators 2 provided in the embodiments of the present disclosure, for at least two actuators 2 whose operating frequencies may be partially the same in the operating state, and the vibrations generated based on the respective operating frequencies can be combined to form at least a target frequency band signal of the audio source. The target frequency band signal may be a frequency band signal corresponding to the same operating frequency of the at least two actuators in the audio source. In some embodiments, the combined attributes of the target frequency band signal may be that the signal gain is higher than the attribute of the frequency band signal corresponding to the same operating frequency in the audio source, especially for the signal gain. For example, the operating frequency ranges of two actuators may have an overlapping range. When the input audio source includes a signal in the overlapping range, both actuators operate and produce combined vibrations, which in turn generate enhanced sound. On the other hand, audio signal in the non-overlapping frequency range is produced by one actuator and may have less gain. In other words, the controller is configured to control two actuators of the two or more actuators to operate, the operating frequency ranges of the two actuators are partially different and overlap at a first frequency range; vibrations produced by the two actuators includes a synthesized target frequency band signal corresponding to the first frequency range; and attributes of the synthesized target frequency band signal are higher than attributes of a frequency band signal corresponding to the first frequency range in the audio source.

It can be understood that for the two actuators 2 with partially the same operating frequency, the frequency signal corresponding to the same operating frequency in the original audio source may be the gain in the frequency band corresponding to the same operating frequency in the audio signal emitted by the display screen 1 after passing through the two actuators, and more specifically, the signal strength may be enhanced. That is, for the two actuators 2 in the same operating state with the same operating frequency, based on the screen sound technology after passing through the actuators 2 and producing sound in the display screen 1, the frequency signal corresponding to the same operating frequency in the original audio source compared with the audio signal obtained through the above processing may be equivalent to the frequency signal corresponding to the same operating frequency in the original audio source being enhanced and output. Based on this method, at least the valid audio data in the original audio source can be enhanced and the noise data can be weakened when output.

The embodiments of the present disclosure will be further described below with different operating frequencies of the actuators in the operating state and/or different operating frequencies of all the actuators.

Figure 2:
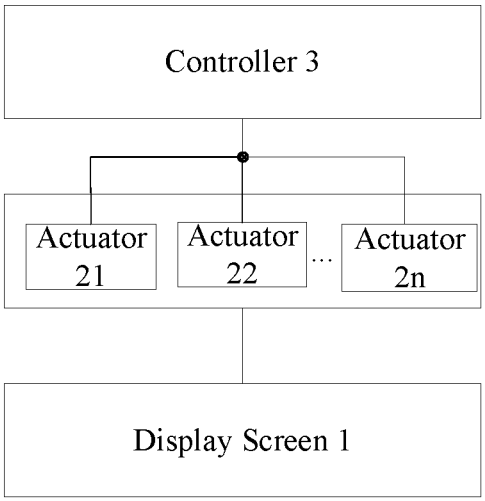
FIG. 2 is a structural diagram of an electronic device according to another embodiment of the present disclosure.

According to an embodiment of the present disclosure, as shown in FIG. 2, the electronic device includes the display screen 1, two or more actuators 2, and the controller 3. The controller may be configured to control one or more of the two or more actuators 2 to be in an operating state to drive the display screen 1 to emit sound.

In some embodiments, the numbers of the two or more actuators 2 in different operating state may be different, and the frequency bands of the sound emitted by the display screen may be different. Further, the controller 3 may be configured to determine that the actuators 2 of different operating frequencies may be in an operating state based on the frequency band of the audio source.

The electronic device shown in FIG. 2 includes n actuators, where n may be a positive integer greater than or equal to 2, such as actuator 21, actuator 22 . . . actuator 2*n*.

In some embodiments, the actuators in the two or more actuators that are in the operating state may be determined based the frequency band of the original (input) audio source. Each actuator in the operating state may combine the original audio source based on its own operating frequency, such as restoring a partial frequency signal or all audio signals in the original audio source. By controlling at least two actuators with different operating frequencies in the two or more actuators in the operating state, the display screen may emit audio signals of different frequency bands, thereby allowing users to listen to richer audio data.

In some embodiments, at least two actuators 2 may have different operating frequencies, and two or more actuators 2 may be in the operating state. The frequency band of the audio source may be combined based on each of the two or more actuators 2 in the operating state vibrating at its own operating frequency. The control of the actuators in the operating state may be determined based on the frequency band of the audio source, and each actuator that is turned on may vibrate based on its own operating frequency, and restore the audio source based on the principle of the screen sound described above. That is, the controller may be configured to identify which one(s) of the two or more actuators are to be used to drive the display screen based on a frequency band of an audio source and the operating frequency ranges of the two or more actuators.

In some embodiments, when the operating frequencies of the two or more actuators 2 are different, when the numbers of the actuators 2 in the operating state of the two or more actuators is a first value, the frequency band that the display screen 1 emits may be at least wider than the frequency band that the display screen 1 emits when he numbers of the actuators 2 in the operating state of the two or more actuators is a second value. In some embodiments, the first value may be greater than the second value. In other words, a frequency band of a sound signal produced by the display screen driven by a first number of operating actuators wider than a frequency band of a sound signal produced by the display screen driven by a second number of operating actuators, where the first number is greater than the second number.

It can be understood that when the operating frequencies of the actuators 2 in the operating state are different, the larger the numbers of the actuators 2 in the operating state, the wider the frequency band of the signal emitted by the display screen. For example, when actuators 2 each has a non-overlapping operating frequency range, more operating actuators 2 can produce sounds having wider frequency band.

In some embodiments, the electronic device further includes two or more frequency dividers 4 and two or more amplifiers 5. The two or more frequency dividers 4 may be configured to divide a frequency band of the audio source to obtain two or more sub-band signals.

One end of the two or more amplifiers 5 may be connected to the two of more frequency dividers, and the other end may be connected to the two or more actuators in the operating state. The two or more amplifiers 5 may be configured to amplify the two or more sub-band signals of the audio source, such that the actuator in the operating state corresponding to the respective sub-band signals can vibrate based on its own operating frequency, to combine the two or more sub-band signals of the audio source.

In some embodiments, the frequency band of the original audio source may be divided to obtain two or more sub-band signals. Each frequency divider may extract from the audio source the audio signal with the same operating frequency as the actuator on the same branch as the sub-band signal. Each frequency divider may input the acquired sub-band signal by itself to an amplifier connected thereto to amplify the sub-band signal. Due to the increase in signal strength, the amplified sub-band signal can make the actuator vibrate more obviously based on its own operating frequency. The obvious vibration can make the display sound clearer, such that the user may listen more clearly. In some cases, one of the purposes of amplification is at least to prevent the actuators from not being able to vibrate due to the signal attenuation of the sub-band signal, which may lead to weak signal strength, thereby avoiding the situation that the display screen cannot produce sound due to the weak signal strength.

The technical solutions of the embodiments of the present disclosure will be described below with reference to FIGS. 3A and 3B, and FIG. 4.

Figure 3A:
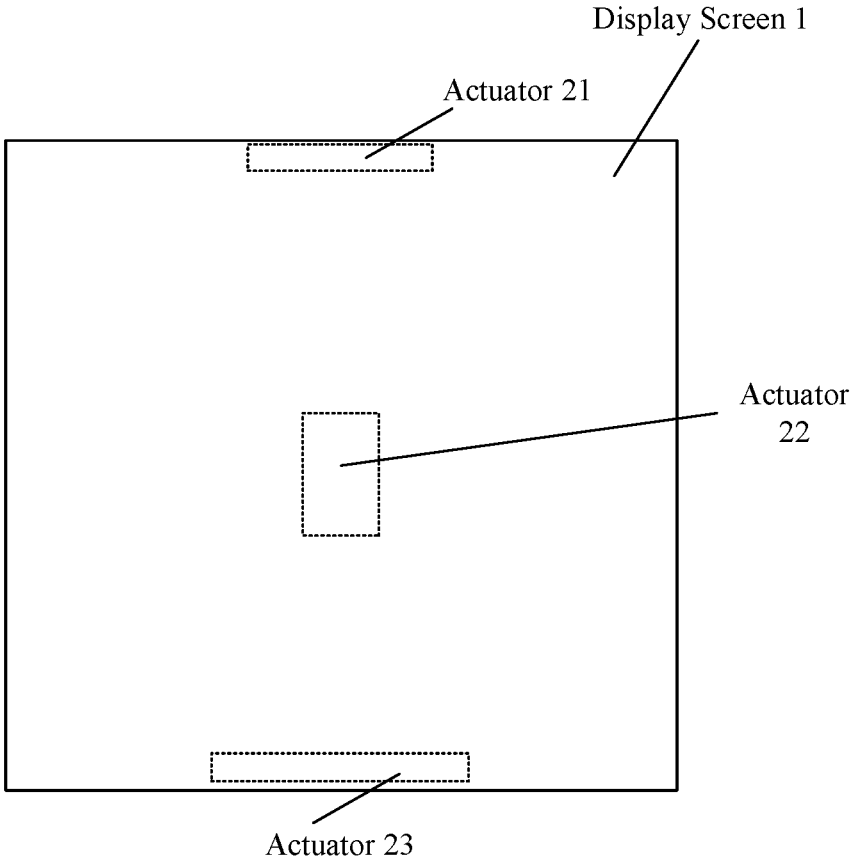
FIGS. 3A and 3B are diagrams of three actuators disposed in the electronic device according to an embodiment of the present disclosure.
Figure 3B:
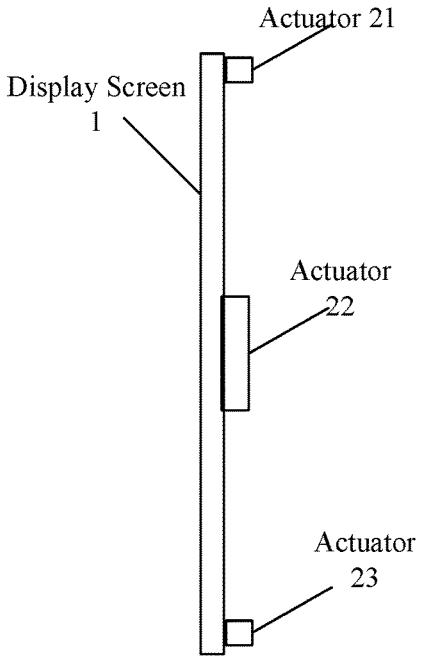

FIGS. 3A and 3B are diagrams illustrating the setting positions of three actuators according to an embodiment of the present disclosure. As shown in FIGS. 3A and 3B, actuators 21 and 22 are respectively disposed at positions above and below the display screen, and actuator 23 is disposed at a position near the center of the display screen. It can be understood that FIGS. 3A and 3B take the numbers of actuators as 3 as an example. In addition, two or three or more actuators may also be used. Each actuator may be disposed inside the electronic device, and the inside of the electronic device may be attached to the back of the display screen (as shown in FIG. 3A, the display screen may be the front of the display screen and the actuators may be indicated by the dash lines), such that the display screen can better detect the vibration frequency of each actuator. In particular, FIG. 3B is a side view of the setting positions of the actuators, where the actuators 21 and 23 are fitted near the edge of the display screen, and the actuator 22 is disposed near the center of the display screen.

Figure 4:
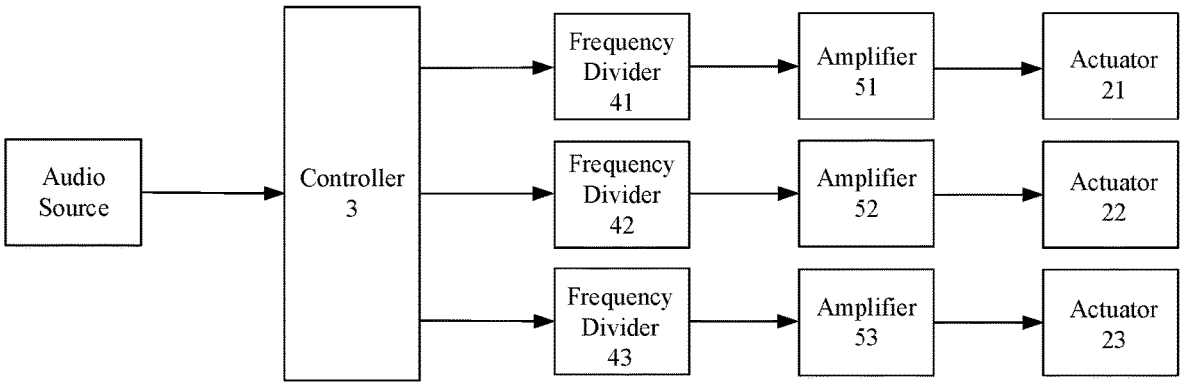
FIG. 4 is a circuit diagram of the electronic device to realize screen-generated sound according to an embodiment of the present disclosure.

Based on the 3 actuators design shown in FIGS. 3A and 3B, FIG. 4 illustrates a corresponding numbers of branches, such as branches 1-3. As shown in the circuit in FIG. 4, the original audio is input to the controller 3. The controller 3 is connected to each frequency divider. One of the each amplifier is connected to the corresponding frequency divider, and the other end of is connected to the corresponding actuator.

Assuming that the electronic device supports ultra-wideband audio signals (frequency between 300 Hz to 16 kHz). At present, the bandwidth division of narrow-band communication system (NB), wideband communication system (WB), and ultra-wideband communication system (STB) may be that the bandwidth of NB is 300 Hz to 4 kHz, the bandwidth of WB is 300 Hz to 8 kHz, and the bandwidth of STB is 300 Hz to 16 kHz. It can be understood that when the electronic device is on the NB network, the frequency of the audio source input to the electronic device may need to be within 300 Hz to 4 kHz. When the electronic device is on the WB network, the frequency of the audio source input to the electronic device may need to be within 300 Hz to 8 kHz. Further, when the electronic device is on the STB network, the frequency of the audio source input to the electronic device may need to be within 300 Hz to 16 kHz.

In order for the electronic device in the embodiments of the present disclosure to output audio sources acquired through the three types of networks above, in some embodiments, the operating frequency of the actuator 21 may be between 300 Hz to 4 kHz, the operating frequency of the actuator 22 may be between 300 Hz to 8 kHz, and the operating frequency of the actuator 23 may be between 300 Hz to 16 kHz.

Based on the design of the actuators described above, the following describes the process in which an electronic device receives an incoming call request from a peer electronic device through various types of networks, and outputs the audio of the peer user under different types of networks.

In the first example, the electronic device may be in the NB network and an incoming call request is received through the NB network, where the frequency of the audio signal (i.e., audio source) in the incoming call request may need to be in the range of 300 Hz to 4 kHz. The controller 3 may control a branch 1 to be turned on (that is, a frequency divider 41, an amplifier 42, and the actuator 21 may be turned on), and transmit the audio source signal received through the NB network to the frequency divider 41. Subsequently, the frequency divider 41 may transmit the audio source signal to the amplifier 51. Considering that the audio source signal is generally a digital signal, the amplifier 51 may first perform a digital-to-analog conversion. Due to the attenuation during conversion, the amplifier 51 may perform a signal gain on the converted analog signal, such as amplifying the signal strength. As such, the actuator 21 may generate its own vibration force at the frequency of the audio source received by the electronic device at this time. The vibration force can cause the display screen to vibrate, and the vibration force generated by the display screen can push the air, thereby generating sound waves and restoring a narrow-band signal.

In the foregoing example, among the three actuators, the operating state (e.g., on) of the actuator 21 may be determined based on the frequency of the audio source currently input by the electronic device. The vibration of the actuator based on its own operating frequency may drive the display screen to emit narrow-band audio. As such, the audio source may be restored. In addition, when only one branch needs to be turned on, the frequency divider on the turned-on branched may be equivalent to a direct connect state, therefore, the audio source may not need to be divided.

In generally, the audio signals supported by the NB network are narrow-band signals (e.g., 20 Hz to 40 kHz), and turning on the branch 1 (e.g., actuator 21) may restore all the narrow-band signals input to the electronic device. That is, the first example can be applied to the NB network. When the audio source input by the electronic device is a narrow-band signal, the narrow-band signal may be completely restored by turning on the branch 1.

In the second example, the electronic device may be in the WB network and an incoming call request is received through the NB network, where the frequency of the audio signal (i.e., audio source) in the incoming call request may need to be in the range of 300 Hz to 8 kHz. The controller 3 may control a branch 1 and a branch 2 to be turned on at the same time, and input the audio source into the frequency dividers 41 and 42. The frequency divider 41 may extract the frequency band signal falling in the actuator 21 from the audio source and transmit the extracted frequency band signal to the amplifier 51. The frequency divider 42 may extract the frequency band signal falling in the actuator 22 from the audio source and transmit the extracted frequency band signal to the amplifier 52. The amplifiers 51 and 52 may convert the respective signals from the digital signals to analog signals, and then amplify the signal gain of the converted analog signals. As such, the actuator 21 may generate vibration at a frequency between 300 Hz to 4 kHz, and the actuator 22 may generate vibration at a frequency between 4 kHz to 8 kHz. The vibration force generated by the actuator 21 and the actuator 22 may be combined such that the display screen may vibrate. The vibration of the display screen may push the movement of the air on the surface of the display screen, thereby generating sound waves and restoring a wide-band signal of 300 Hz to 4 kHz.

In generally, the audio signals supported by the WB network are wide-band signals (e.g., 300 Hz to 8 kHz), and turning on the branches 1 and 2 may restore all the wide-band signals input to the electronic device. That is, the second example can be applied to the WB network. When the audio source input by the electronic device is a wide-band signal, the wide-band signal may be completely restored by turning on the branches 1 and 2.

In the third example, the electronic device may be in the STB network and an incoming call request is received through the NB network, where the frequency of the audio signal (i.e., audio source) in the incoming call request may need to be in the range of 300 Hz to 16 kHz. The controller 3 may control all branches to be turned on, and each branch may perform the process based on the previous description. For example, the actuator 21 on the branch 1 may generate vibration at a frequency between 300 Hz to 4 kHz, the actuator 22 on the branch 2 may generate vibration at a frequency between 4 kHz to 8 kHz, and the actuator 23 on the branch 3 may generate vibration at a frequency between 8 kHz to 16 kHz. The combined vibration of the three actuators can cause the display screen to vibrate. The vibration of the display screen may push the movement of the air on the surface of the display screen, thereby generating sound waves and restoring a wide-band signal of 300 Hz to 16 kHz.

In generally, the audio signals supported by the STB network are ultra-wide band signals (e.g., 300 Hz to 16 kHz), and turning on the branches 1, 2 and 3 may restore all the ultra-wideband signals input to the electronic device. That is, the second example can be applied to the STB network. When the audio source input by the electronic device is an ultra-wideband signal, the ultra-wideband signal may be completely restored by turning on the branches 1, 2, and 3.

As described above, compared with the narrow-band signal restored in the first example, the wide-band signal may be restored in the second example, and the ultra-wideband signal may be restored in the third example. It can be understood that, for the same electronic device, when the operating frequencies of the actuators are different, as the numbers of actuators being controlled increases, the wider the frequency band of the screen sound may be. Those skilled in the art should understand that the low frequency portion of the audio generally represent the basic information of the audio, and the high on of the audio generally represent the details of the audio. With the widening of the frequency band of the screen sound, the effect of the audio restored by the electronic device may be better.

In practical applications, by applying the technical solutions described above, the design of two or more actuators may avoid the situation of poor user experience due to excessively wide frequency band of the audio source input, such as wide-band or ultra-wideband signals, and a signal actuator cannot completely restore the wide-band or ultra-wideband signals.

In the foregoing technical solutions, the amplifiers 51, 52, and 53 may be specifically power amplifiers, which can at least realize the conversion of digital signals to analog signals, and amplification of analog signals.

In the foregoing technical solutions, each actuator may operate at different operating frequencies, and the actuators at different operating frequencies may generate signals in different frequency bands when the numbers of actuators allowed to be turned on is different. If the combined operating frequencies of the all the actuators in the operating state can cover all frequencies of the audio source, all the frequency signals of the audio source may be restored (e.g., if the audio source input to the electronic device is an ultra-wideband signal, and all three branches are turned on). As such, the user may fully listen to the audio source signal. In addition, when the operating frequency of each actuator is different, for the input ultra-wideband signal, the greater the numbers of actuators in the operating state, the better the audio source may be restored, and the requirements for outputting signals of different frequencies may be met.

If the operating frequency of the actuator 22 is set to 4 kHz to 9 kHz, it can be seen that the operating frequencies of the actuator 22 and the actuator 23 have a same portion (i.e., 8 kHz to 9 kHz). When the actuators 22 and 23 are allowed to be turned on, the audio signals of 8 kHz to 9 kHz may be similarly processed in branches 2 and 3 as described above. The actuators 21, 22, and 23 may generate vibrations at their respective operating frequency points, and then drive the display screen to emit audio signals, thereby restoring the audio source. In particular, for the same frequency of actuators 22 and 23, both actuators may generate vibrations of the corresponding frequency at the same frequency. The vibration force may be increased relative to a single actuator, and the increased vibration force may appear as a strong acoustic signal in the sound wave. That is, the strength of the audio signal with a frequency of 8 kHz to 9 kHz in the audio source may be enhanced such that the user may listen to this signal.

In the previous description, the operating frequencies of the actuators 21, 22, and 23 are arranged in an ascending order. In some embodiments, since the actuators 21 and 23 can be disposed near the edge of the display screen and the actuator 22 may be disposed near the center of the display screen, compared with eth positions of the actuators 21 and 23, the vibration frequency of the display screen generated by the actuator 22 may be easier to perceive. As such, the operating frequency of the actuator 22 is generally the most desire or easily restored audio frequency, such as the lower frequency in the audio source (compared with high frequency, since the low frequency represents basic information of the audio and high frequency represents details information of the audio, priority should be given to ensure that low frequency is restored first). In the three actuators, the controller 3 may need to ensure at least the actuator near the center of the display screen is in the operating state, that is, the actuator 22, to generate the frequency vibration. The display screen may generate the sound wave by pushing air, and restore the audio signal.

Those skilled in the art should understand that FIG. 3 and FIG. 4 are merely examples, and do not limit the embodiments of the present disclosure. Any reasonable conjectures and inference are within the protection scope of the embodiments of the present disclosure.

An embodiment of the present disclosure provides a control method. The method may be applied to an electronic device, and the electronic device may include a display screen and two or more actuators. The control method will be described in detail below.

601, controlling at least one of the two or more actuators to be in an operating state.

602, driving the display screen to sound by using the at least one actuator in the operating state, where when the numbers of the two or more actuators in the operating is different, the frequency band of the display screen sound may be different.

In the technical solution described above, the electronic device may include a controller. The controller may be configured to control at least one of the two or more actuators to be in the operating state to drive the display screen to emit a sound. In some embodiments, where when the numbers of the two or more actuators in the operating is different, the frequency band of the display screen sound may be different.

In the technical solution described above, the operating frequencies of the two or more actuators may be different or partially different, or the operating frequencies of the two or more actuators may be the same.

In the technical solution described above, if the operating frequencies of the two or more actuators are different, the controller may be configured to determine the actuators of different operating frequencies in the operating state based on the frequency band of the audio source.

In the technical solution described above, the two or more actuators may have different operating frequencies, and the two or more actuators may be in the operating state. The frequency band of the audio source can be synthesized based on the vibration of each of the two or more actuators in the operating state at their own operating frequency.

In the technical solution described above, for the two or more actuators that are at least partially in the same operating state, the target frequency band signal of the audio source may be synthesized based on the vibration generated by the respective operating frequency bands. The target frequency band signal may be a frequency band signal corresponding to the same operating frequency of the two or more actuators in the audio source. In some embodiments, the attribute of the synthesized target frequency band signal may be higher than the attribute of the frequency band signal corresponding to the same operating frequency band in the audio source.

In the technical solution described above, when the operating frequencies of the two or more actuators are different, when the numbers of the actuators in the operating state of the two or more actuators is a first value, the frequency band that the display screen emits may be at least wider than the frequency band that the display screen emits when he numbers of the actuators in the operating state of the two or more actuators is a second value. In some embodiments, the first value may be greater than the second value.

In the technical solution described above, the electronic device may further include two or more amplifiers. The two or more amplifiers may be connected to the two or more actuators in the operating state, and may be configured to amplify two or more sub-band signals of the audio source. As such, the actuator in the operating state corresponding to each of the sub-band signal may vibrate based on its own operating frequency to at least synthesize the two or more sub-band signals of the audio source.

In the technical solution described above, the electronic device may further include two or more frequency dividers. The two or more frequency dividers may be configured to the two or more amplifiers, and configured to divide the audio source based on the frequency band of the audio source to obtain the two or more sub-band signals.

In the technical solution described above, the two or more actuators may be disposed at different positions on the display screen. The actuator disposed at a position near the center of the display screen may be controlled to be in the operating state prior to the actuator disposed at a distance from the center of the display screen.

It should be noted that, for the method embodiment of the present disclosure, the principle of the technical solution is similar to the electronic device described above. As such, for the implementation process and implementation principle, reference may be made to the foregoing description of the implementation process and implementation principle of the electronic device, and will not be repeated herein again.

In some embodiments provided by the disclosure, it should be understood that the disclosed equipment and method may be implemented in another manner. The equipment embodiment described above is only schematic, and for example, division of the units is only logic function division, and other division manners may be adopted during practical implementation. For example, multiple units or components may be combined or integrated into another system, or some characteristics may be neglected or not executed. In addition, coupling or direct coupling or communication connection between each displayed or discussed component may be indirect coupling or communication connection implemented through some interfaces, equipment or units, and may also be electrical and mechanical or adopt other forms.

The units described as separate parts may or may not be physically separated, and parts displayed as units may or may not be physical units, and namely may be located in the same place, or may also be distributed to multiple network units. Part or all of the units may be selected to achieve a purpose of the solutions of the embodiment according to a practical requirement.

In addition, each function unit in each embodiment of the disclosure may be integrated into a processing unit, each unit may also exist independently, and two or more than two units may also be integrated into a unit. The integrated unit may be implemented in a hardware form, and may also be implemented in form of combining hardware and a software function unit.

Those skilled in the art should know that: all or part of the steps of the method embodiment may be implemented by related hardware instructed through a program, the program may be stored in a computer-readable storage medium, and the program is executed to execute the steps of the method embodiment; and the storage medium includes: various media capable of storing program codes, such as mobile storage equipment, a Read-Only Memory (ROM), a magnetic disk or a compact disc.

Alternatively, when the integrated unit is implemented in the form of a software functional unit and sold or used as an independent product, the integrated unit may be stored in a computer-readable storage medium. Based on such an understanding, the technical solutions of the present disclosure essentially, or the part contributing to the prior art, or all or some of the technical solutions may be implemented in the form of a software product. The software product is stored in a storage medium and includes several instructions for instructing a computer device (which may be a personal computer, a server, or a network device) to perform all or some of the steps of the methods described in the embodiments of the present disclosure. The foregoing storage medium includes: any medium that can store program code, such as a USB flash drive, a removable hard disk, a read-only memory (ROM), a random access memory (RAM), a magnetic disk, or an optical disc.

The foregoing descriptions are merely specific implementation manners of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

The specific embodiments of the present disclosure described above are not intended to limit the scope of the present disclosure. Any corresponding change and variation performed according to the technical idea of the present disclosure shall fall within the protection scope of the claims of the present disclosure.

What is claimed is:

1. An electronic device, comprising:

a display screen;

actuators configured to drive the display screen to vibrate, each having a different operating frequency range; and a controller configured to identify at least one of the actuators based on a frequency band of an audio source and operating frequency ranges of the actuators and to control at least one of the actuators to operate and drive the display screen to produce a sound through vibration, wherein the display screen is driven to produce sounds in different operating frequency ranges of the actuators when different numbers of the actuators are operating.

2. The electronic device of claim 1, wherein:

the controller is further configured to control at least two of the actuators to operate at different frequencies to produce synthesized vibrations in the frequency band of the audio source.

3. The electronic device of claim 1, wherein:

the controller is configured to control at least two of the actuators to operate according to the audio source, wherein the operating frequency ranges of the at least two actuators are partially different and overlap at a first frequency range;

vibrations produced by the at least two actuators include a synthesized target frequency band signal corresponding to the first frequency range; and attributes of the synthesized target frequency band signal are higher than attributes of a frequency band signal corresponding to the first frequency range in the audio source.

4. The electronic device of claim 1, wherein:

the operating frequency ranges of the actuators are different, a frequency band of a sound signal produced by the display screen driven by a first number of the actuators wider than a frequency band of a sound signal produced by the display screen driven by a second number of the actuators, and the first number is greater than the second number.

5. The electronic device of claim 1, further comprising:

two or more amplifiers each connected to one of the actuators in operation, and configured to amplify one of two or more sub-band signals of the audio source, wherein the actuators connected to the two or more amplifiers vibrate based on the respective operating frequency ranges to synthesize at least the two or more sub-band signals of the audio source.

6. The electronic device of claim 5, further comprising:

two or more frequency dividers, each connected to the controller and one of the two or more amplifiers, and configured to divide the audio source based on the frequency band of the audio source to obtain the two or more sub-band signals.

7. The electronic device of claim 1, wherein:

the actuators are disposed at different positions of the display screen, and the controller is configured to activate an actuator disposed near a center position of the display screen to operate before activating an actuator disposed further away from the center position of the display screen.

8. A control method, applied to an electronic device including a display screen and actuators comprising:

providing each of the actuators having a different operating frequency range;

identifying at least one of the actuators based on a frequency band of an audio source and operating frequency ranges of the actuators;

controlling at least one of the actuators to operate and drive the display screen to produce a sound through vibration, wherein the display screen is driven to produce sounds in different operating frequency ranges when different numbers of the actuators are operating.

9. The method of claim 8, further comprising:

controlling at least two of the actuators to operate at different frequencies to produce synthesized vibrations in the frequency band of the audio source.

10. The method of claim 8, further comprising:

controlling at least two of the actuators to operate according to the corresponding audio source, wherein the operating frequency ranges of the at least two actuators are partially different and overlap at a first frequency range;

vibrations produced by the at least two actuators include a synthesized target frequency band signal corresponding to the first frequency range; and attributes of the synthesized target frequency band signal are higher than attributes of a frequency band signal corresponding to the first frequency range in the audio source.

11. The method of claim 8, wherein:

the operating frequency ranges of the actuators are different, a frequency band of a sound signal produced by the display screen driven by a first number of the actuators wider than a frequency band of a sound signal produced by the display screen driven by a second number of the actuators, and the first number is greater than the second number.

12. The method of claim 8, further comprising:

amplifying, by two or more amplifiers, two or more sub-band signals of the audio source, each amplifier being connected to one of the actuators in operation; and synthesizing at least the two or more sub-band signals of the audio source by vibrating the actuators connected to the two or more amplifiers based on the respective operating frequency ranges.

13. The method of claim 12, further comprising:

dividing the audio source based on the frequency band of the audio source to obtain the two or more sub-band signals.

14. The method of claim 8, wherein the actuators are disposed at different positions of the display screen, and the method further comprises:

activating an actuator disposed near a center position of the display screen to operate before activating an actuator disposed further away from the center position of the display screen.

* * * * *